US005908337A

United States Patent [19]

Mashiko

[11] Patent Number: 5,908,337

[45] Date of Patent: Jun. 1, 1999

[54] AIR INTAKE FOR PERSONAL WATERCRAFT ENGINE

[75] Inventor: Tetsuya Mashiko, Iwata, Japan

[73] Assignee: Yamaha Hatsudoki Kabushiki Kaisha, Iwata, Japan

[21] Appl. No.: 08/919,713

[22] Filed: Aug. 28, 1997

[30] Foreign Application Priority Data

Aug. 30, 1996 [JP] Japan ..... 8-248891

[51] Int. Cl.[6] ..... B63H 21/38

[52] U.S. Cl. ..... 440/88; 55/385.3

[58] Field of Search ..... 440/88; 123/198 E; 55/385.3; 181/229; 180/68.3

[56] References Cited

U.S. PATENT DOCUMENTS

Re. 31,877 5/1985 Nomura .
Re. 31,994 10/1985 Tominaga et al. .
4,319,657 3/1982 Nomura .
4,760,703 8/1988 Minami et al. .
4,900,343 2/1990 Minami et al. .
5,340,344 8/1994 Mineo et al. .
5,558,549 9/1996 Nakase et al. ..... 440/88

*Primary Examiner*—Sherman Basinger
*Attorney, Agent, or Firm*—Knobbe, Martens, Olson & Bear LLP

[57] ABSTRACT

An air intake for an engine of the type powering a water propulsion device of a watercraft is disclosed. The air intake includes an air box with at least one intake opening leading into an interior chamber. An intake passage leads from a combustion chamber of the engine to the interior chamber of the air box. The intake passage is defined at least in part by an intake pipe having a free end positioned within the interior chamber of the air box. The free end of the intake pipe is flared. In addition, one or more drain passages are preferably provided in the air box for allowing water to flow from the box to a point exterior thereof.

17 Claims, 6 Drawing Sheets

AIR INTAKE FOR PERSONAL WATERCRAFT ENGINE

FIELD OF THE INVENTION

The present invention relates to an air intake. More particularly, the invention is an air intake arrangement for an engine of the type powering a watercraft.

BACKGROUND OF THE INVENTION

Watercraft, especially those of the type known as personal watercraft, are commonly powered by internal combustion engines positioned within their hulls. These engines are arranged to drive a water propulsion device for propelling the craft.

As is well known, it is undesirable to allow water to enter the intake system of such an engine, as the water may foul the combustion chamber(s) and cause the engine to stall or stop. In addition, the water may be passed through the engine to a catalyst positioned in the exhaust system, damaging it as well.

It is common for the air intake to be positioned at the top of the engine and may open upwardly. In the watercraft setting, this is undesirable, since water may flow directly into the intake and down into the engine. Thus, as one method for reducing the opportunity for water to enter the intake system, the air intake opening leading to the engine may be positioned within an air box, with air supplied to the air box through an inlet or pipe.

A problem also exists with this arrangement relating to the nature of personal watercraft. This type of watercraft is often capsized, laying on either side or completely upside down. When this occurs, water in the engine compartment or elsewhere may then still enter the air box or air intake to the engine.

An improved air intake arrangement for an engine of the type utilized to power a watercraft is desired.

SUMMARY OF THE INVENTION

In accordance with the present invention there is provided an air intake system for an engine, the engine preferably of the type arranged to power a water propulsion device of a watercraft such as a personal watercraft.

The air intake is especially useful with an engine of the type positioned in a hull of the watercraft and having at least one combustion chamber and a fuel supply for supplying fuel to the combustion chamber for combustion.

The air intake is arranged to supply air to the combustion chamber of the engine, but also arranged to prevent the entry of water into the engine. Preferably, the air intake includes an air box having at least one opening leading to an interior chamber. The air intake also includes an intake passage extending from the combustion chamber to an intake pipe having its end positioned within the interior chamber of the air box.

In accordance with the present invention, the end of the intake pipe within the air box is flared. In a preferred embodiment, the intake pipe comprises a wail extending upwardly from a bottom surface of the air box, the wall defining a passage therethrough leading from the interior chamber to the intake passage leading to the combustion chamber. An air horn is connected to the wall defining the intake pipe and extends upwardly into the interior chamber. The air horn has a free end which has an increasing diameter in the direction away from the intake pipe.

In the preferred embodiment one or more drain passages are provided in a bottom of the air box for allowing water which enters the box to flow from the interior chamber to a point exterior of the box. In addition, the opening(s) leading into the air box preferably faces downwardly towards the hull of the watercraft.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is an air intake for an engine. The air intake is particularly suited for use with an engine utilized to power a watercraft, and more particularly, a personal watercraft.

Figure 1:
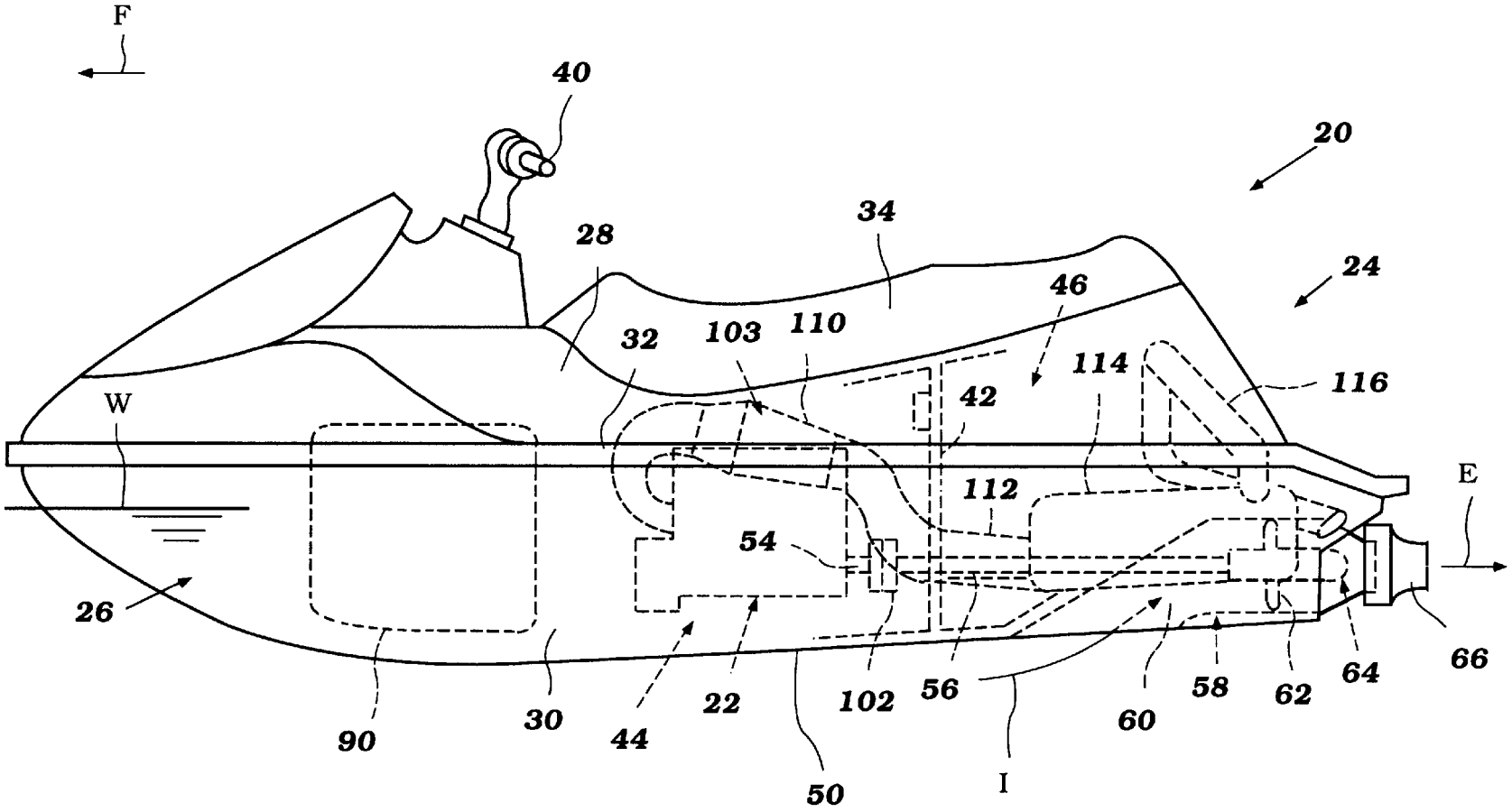
FIG. 1 is a side view of a personal watercraft of the type powered by an engine having an air intake in accordance with the present invention, the engine and other watercraft components positioned within a hull of the watercraft illustrated in phantom.
Figure 2:
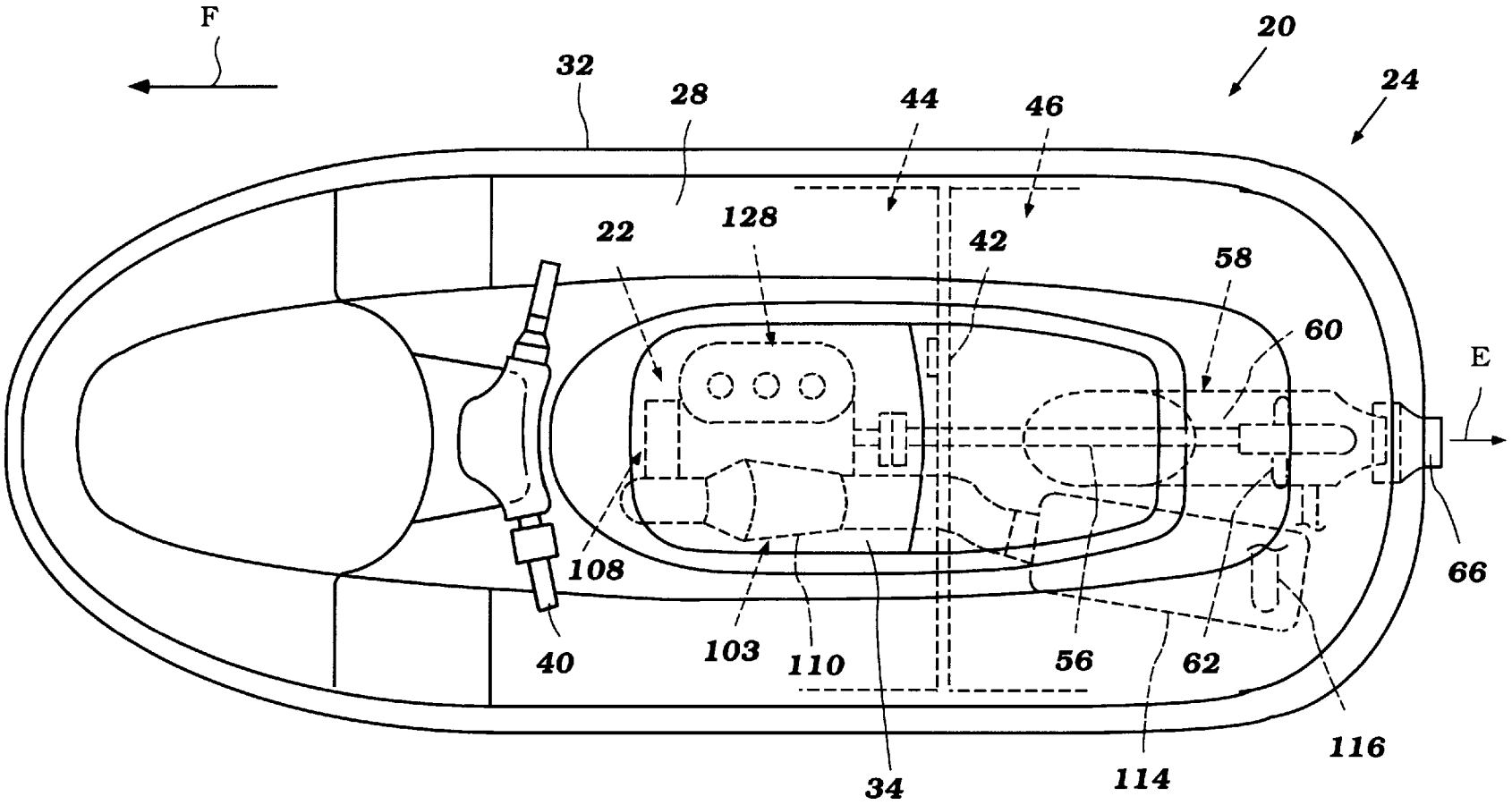
FIG. 2 is a top view of the watercraft illustrated in FIG. 1, with the engine and other watercraft components positioned within the hull of the watercraft illustrated in phantom.

FIGS. 1 and 2 illustrate a watercraft 20 having a watercraft body 24 comprising a hull 26 having a top portion or deck 28 and a lower portion 30. A gunnel 32 defines the intersection of the hull 26 and the deck 28.

A seat 34 is positioned on the top portion 28 of the hull 26. The seat 34 may be connected to a removable deck member for use in accessing an engine compartment within the hull 26, as described in more detail below. A steering handle 40 is provided adjacent the seat 32 for use by a user in directing the watercraft 20.

Figure 3:
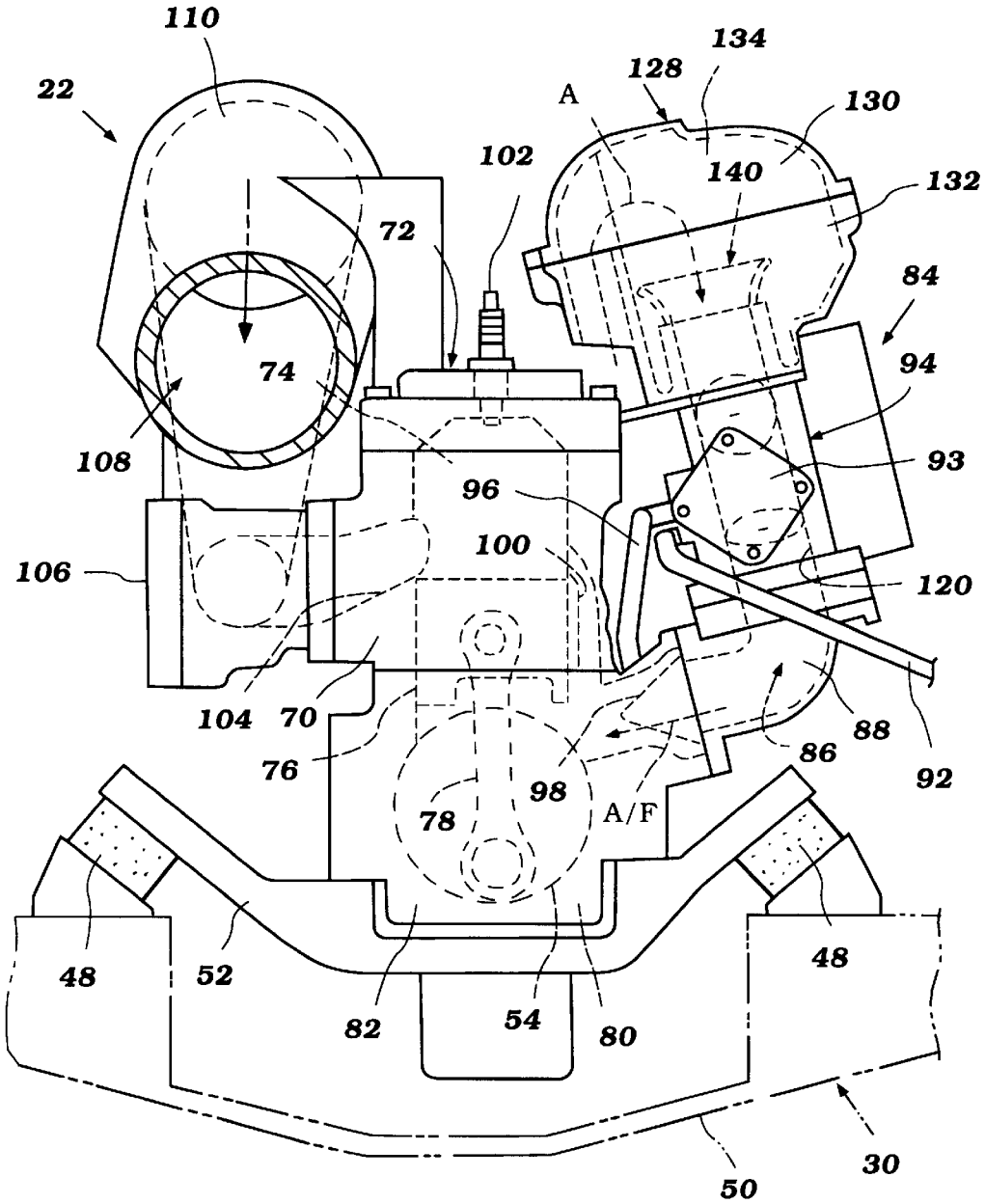
FIG. 3 is an end view, in partial cross-section, of the engine illustrated in FIG. 1.

The top and bottom portions 28,30 of the hull 26, along with a bulkhead 42, define an engine compartment 44 and a pumping chamber 46. An engine 22 is positioned in the engine compartment 44. As best illustrated in FIG. 3, the engine 22 is connected to the hull 26 via several engine mounts 48 connected to a bottom 50 of the lower portion 30 of the hull 26. The mounts 48 connect an engine support plate 52 to the hull 26. Preferably, the engine mounts 48 include at least one section comprising a material for damping vibration transmission between the hull 26 and engine 22. The engine 22 is preferably partially accessible through a maintenance opening accessible by removing the removable deck member on which the seat 34 is mounted.

The engine 22 has a crankshaft 54 (see FIG. 1) which is in driving relation with an impeller shaft 56. The impeller shaft 56 rotationally drives a means for propelling water of a propulsion unit 58, which unit extends out a stem portion of the watercraft 20 (i.e. that end of the watercraft 20 opposite the front end facing in the direction F in FIG. 1).

The propulsion unit 58 includes a propulsion passage 60 having an intake port which extends through the lower portion 30 of the hull 26 through which water is drawn in the direction I. The means for propelling water, preferably an impeller 62 driven by the impeller shaft 56, is positioned in the passage 60. The passage 60 also has an outlet 64 positioned within a nozzle 66. The nozzle 66 is mounted for movement up and down and to the left and right, for expelling water E under force, whereby the direction of the propulsion force for the watercraft 20 may be varied.

The engine 22 is best illustrated in FIG. 3. As illustrated therein, the engine 22 is preferably of the three-cylinder, two-cycle variety. Of course, the engine 22 may have as few as one, or more than three, cylinders, as may be appreciated by one skilled in the art. In addition, the engine may operate on a four-cycle or other operating principle.

The engine 22 includes a cylinder block 70 having a cylinder head 72 connected thereto and cooperating therewith to define two combustion chambers 74. Each combustion chamber 74 is defined by a cylinder wall within the block 70, a recessed area in the cylinder head 72, and the head of a piston 76. A piston 76 is movably mounted in each cylinder, and connected to the crankshaft 54 via a connecting rod 78, as is well known in the art.

The crankshaft 54 is rotatably journalled by a number of sealed bearings with respect to the cylinder block 70 within a crankcase chamber 80. Preferably, the chamber 80 is defined by a crankcase cover member 82 which extends from a bottom portion of the cylinder block 70. As is well known, the crankshaft 54 has pin portions extending between web portions thereof, with each connecting rod 78 connected to one of the pin portions and the web portions rotatably supported by the bearings mounted to members extending from the block 70 and cover 82.

As illustrated in FIG. 3 and as described in more detail below, the engine 22 includes means for providing an air and fuel mixture to each combustion chamber 74. Preferably, air is drawn into the engine compartment 44 through one or more air inlets in the hull 26. Air is then drawn through an air intake 84 described in more detail and in accordance with the present invention, and delivered through an intake passage 86 in an intake manifold 88 to the engine 22.

Fuel is provided to each combustion chamber 74 for combustion. Preferably, fuel is combined with the incoming air. In particular, fuel is drawn from a fuel tank 90 (see FIG. 1) positioned in the engine compartment 44 by a fuel pump 93 and delivered through a fuel delivery line 92 to a charge former such as a carburetor 94.

Figure 4:
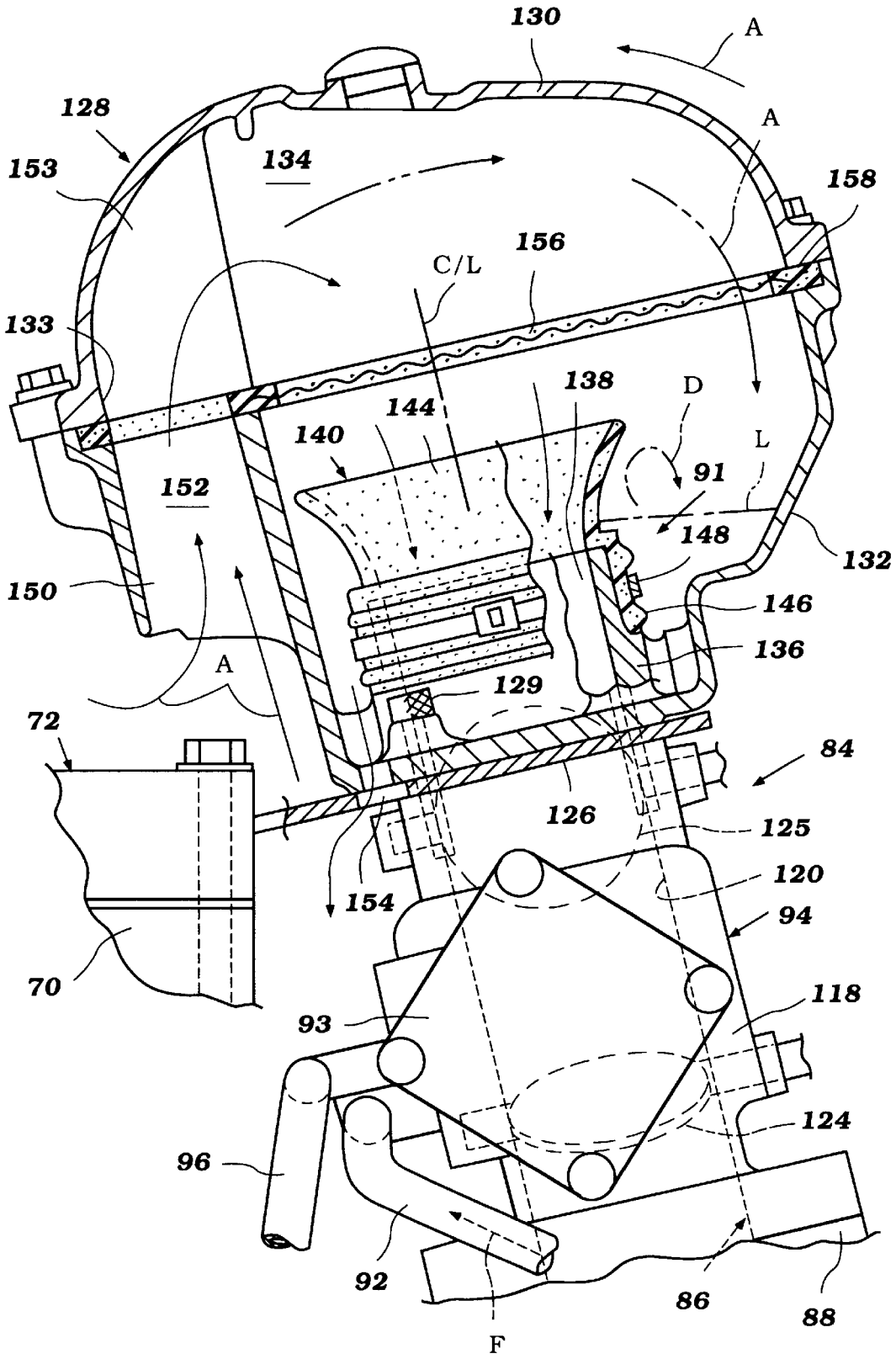
FIG. 4 is a side view, in partial cross-section, of an air intake of the engine illustrated in FIG. 3.

Referring to FIGS. 3 and 4, a throttle valve 124 and a choke valve 125 are preferably provided for allowing the watercraft operator to control the rate of fuel and air delivery to the engine 22 for controlling the speed and power output of the engine via a throttle linkage and choke linkage of the carburetor 94.

Fuel which is delivered to the carburetor 94 but not delivered to the air flowing therethrough may be returned to the fuel tank 90 through a return line 96. It is contemplated that the fuel may be provided to the engine by indirect or direct fuel injection, as well as via carburation, as known in the art.

The air and fuel mixture (labeled A/F in FIG. 3) selectively passes through an intake port into the crankcase chamber 80 as controlled by a reed valve 98, as is known in the art. As is also well known, an intake port and corresponding reed valve 98 are preferably provided corresponding to each combustion chamber 74. The crankcase chamber 80 is compartmentalized so as to provide a crankcase compression feature for each combustion chamber as is well known in the operation of two-cycle engines.

The fuel and air charge within the crankcase chamber 80 is delivered to its respective combustion chamber 74 through at least one scavenge passage 100 leading to one or more scavenge ports in the cylinder wall.

A suitable ignition system is provided for igniting the air and fuel mixture provided to each combustion chamber. Preferably, this system comprises a spark plug 102 corresponding to each combustion chamber 74. Each spark plug 102 is preferably fired by a suitable ignition system.

Though not illustrated, the engine 22 may include a flywheel connected to one end of the crankshaft 54 and having a number of magnets thereon for use in a pulser-coil arrangement for generating firing signals for the ignition system. In addition, the ignition system may include a battery for use in providing power to an electric starter and other electrical engine features. In addition, a number of teeth may be mounted on the periphery of the flywheel for use in starting the engine 22 with a starter motor (not illustrated).

The engine 22 includes a lubricating system for providing lubricating oil to the various moving parts thereof Preferably, the lubricating system includes an oil tank or reservoir (not shown) from which lubricating oil is delivered to and circulated throughout the engine, as is well known to those skilled in the art.

The engine 22 may also preferably include a suitable cooling system (not shown) as known to those skilled in the art.

As stated above, the crankshaft 54 drives the impeller 56 of the propulsion unit 58. Referring to FIG. 1, the end of the crankshaft 54 extends through the crankcase cover to a coupling 102 where it is coupled to an end of the impeller shaft 56.

Still referring to FIG. 1, exhaust gas generated by the engine 22 is routed from the engine to a point external to the watercraft 20 by an exhaust system 103 which includes an exhaust passage 104 leading from each combustion chamber 74 through the cylinder block 70. An exhaust manifold 106 is connected to a side of the engine 22. The manifold 106 has three branches with passages leading therethrough (corresponding to the three combustion chambers 74) aligned with the passages 104 leading through the cylinder block 70. Exhaust generated by each combustion chamber 74 is routed through a respective passage 104 to the manifold 104.

The branches of the manifold 104 merge into a single passage 108. This portion of the manifold leads to an expansion pipe 110 positioned generally above the engine 22. The expansion pipe 110 has an enlarged passage or chamber through which exhaust routed from the passage 108 in the exhaust manifold flows.

Exhaust flows from the expansion pipe 110 into an upper exhaust pipe section 112 of the exhaust system. This portion of the exhaust system is tapers to a smaller diameter from that of the expansion pipe 110. This exhaust pipe 112 leads to a water lock 114. The exhaust pipe 112 is preferably connected to the water lock 114 via a flexible fitting, such as a rubber sleeve. The exhaust flows through the water lock 114, which is preferably arranged as known to those skilled in the art, and then passes to a lower exhaust pipe 116 which has its terminus in the chamber 62. In this manner, exhaust flows from the engine 22 through the exhaust system to its discharge within the water flowing through the chamber 62. A catalyst (not shown) may be positioned within the exhaust system 103 for catalyzing the exhaust gases.

Means (not shown) are provided for controlling the flow of exhaust gases through the exhaust passages 104 from the combustion chambers 74. This means may comprise a sliding knife, rotating or other type valve, and means for moving the valve, as well known to those skilled in the art.

FIGS. 3–6 illustrate in more detail the air intake system 84 of the present invention. As illustrated, the intake manifold 88 extends outwardly from the engine 22 and then curves upwardly to each carburetor 94. An intake passage 86 is provided through the manifold 88 corresponding to each cylinder or combustion chamber 74. A carburetor 94 is provided corresponding to each combustion chamber 74 as well. Thus, in the present embodiment there are three passages 86 and three carburetors 88. Each carburetor 94 preferably comprises a body 118 having a passage 120 therethrough leading, at a bottom end, to the passage 86 in the manifold 88.

The throttle valve 124, which is preferably of the butterfly type, is positioned within the passage 120 through the body 118 of the carburetor 94. In addition, the choke valve 125, which is also preferably of the butterfly type, is positioned within the passage 120 through the body 118 of the carburetor 94 upstream of the throttle valve 124.

A mounting plate 126 is connected to the body 118 of each carburetor 94 opposite its end connected to the intake manifold 88. The mounting plate 126 preferably has a passage therethrough in alignment with the passage 120 through the body 118 of each carburetor 94. The mounting plate 126 is preferably connected to the head 72 of the engine 22.

Figure 5:
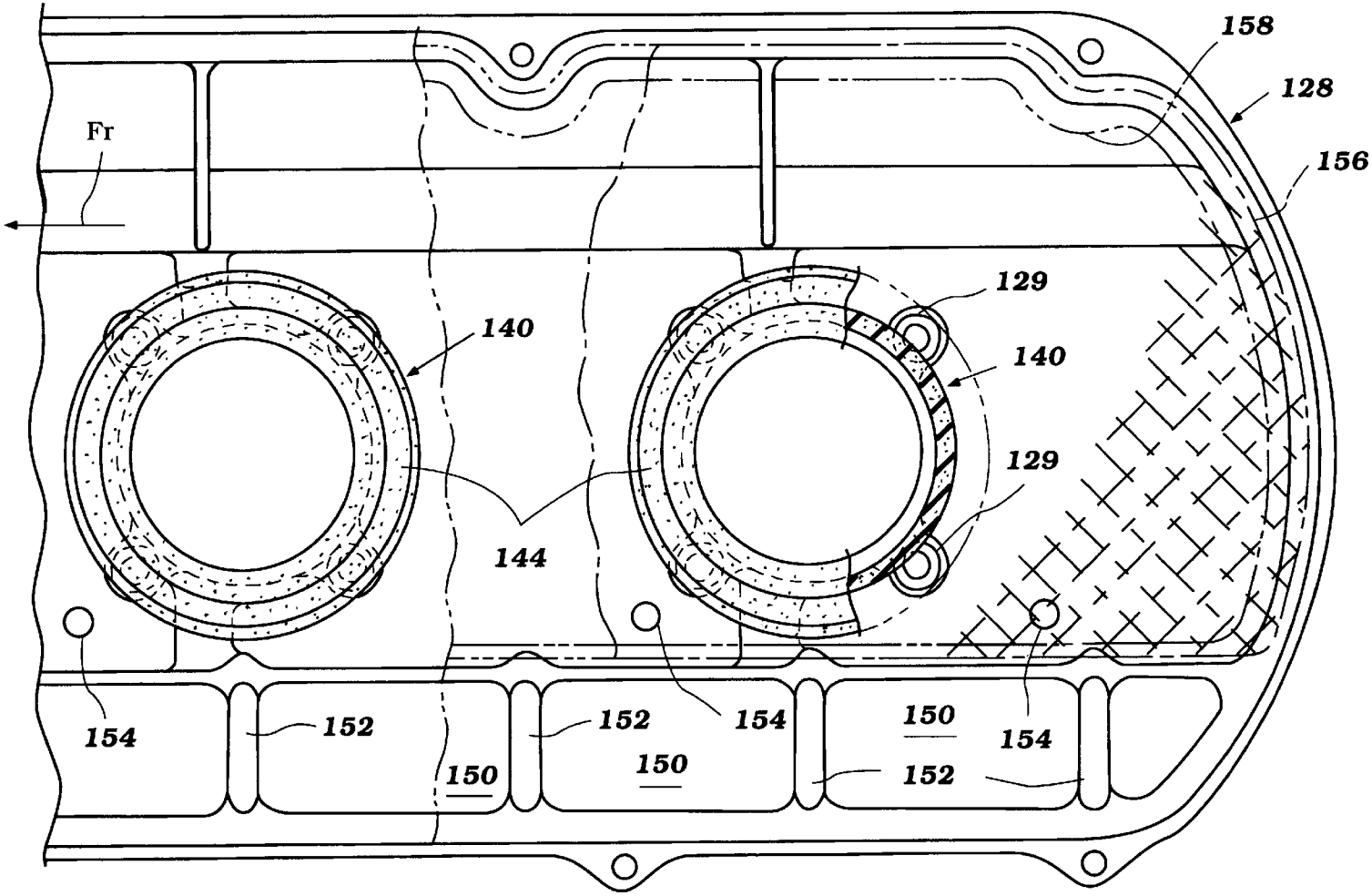
FIG. 5 is an enlarged cross-sectional top view of the air intake illustrated in FIG. 4.
Figure 6:
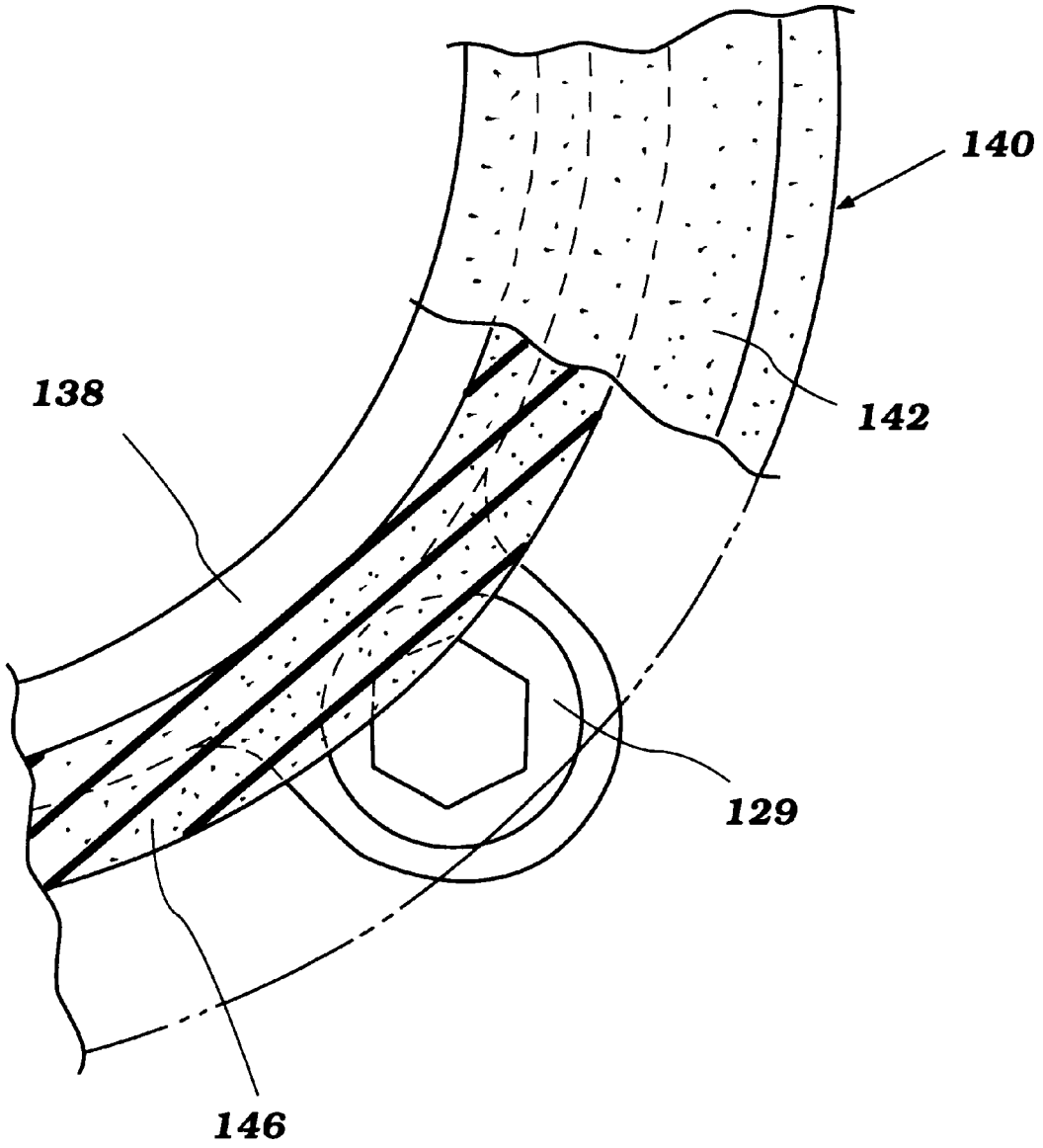
FIG. 6 is an enlarged cross-sectional view of a portion of an air horn of the air intake illustrated in FIG. 5.

An intake box or cover 128 is positioned above the mounting plate 126. The box 128 preferably comprises a top member 130 or cover connected to a bottom member 132 or base. As best illustrated in FIG. 5, the members 130,132 have a length (i.e. corresponding to the forward/rear direction of the watercraft 20) which is greater than their width (i.e. corresponding to the side-to-side direction of the watercraft 20). The bottom member 132 has a wall defining a trough having an open top. The top member 130 is similarly shaped, but is oriented upside down as compared to the bottom member 132, and thus has an inner wall 133 defining a trough but having its bottom end open. When joined, the top and bottom members 130,132 define an interior chamber 134.

The top member 130 is preferably connected to the bottom member 132 by bolts or other fastening means known to those skilled in the art. Of course, the box 128 may be formed as a single element. This has the disadvantage, however, of making it difficult to access the interior of the box including an air filter described in more detail below.

The entire box 128 is connected to the mounting plate 126 and the carburetor body 118 by several bolts 129. Referring to FIG. 5, the bolts. 129 are preferably positioned around and adjacent each wall 136, whereby when the bolts 129 are tightly secured the bottom surface of the bottom member 132 tightly engages the plate 126, preventing air passing through the passage 138 from leaking therebetween.

As illustrated, the air box 128 is arranged so that the bottom member 130 is closer to the bottom portion 50 of the hull than the top member 128.

Individual intake pipes 91 are provided for delivering air from the chamber 134 to the sequence of passages leading to each combustion chamber 74, including the passage 120 leading through the carburetor 94 and the passage 86 through the intake manifold 88. Preferably, each intake pipe has one end positioned within the interior chamber, this end being flared or of otherwise larger diameter than the remainder of the pipe leading to the passage 120.

In the preferred embodiment, the intake pipe comprises a wall 136 extending from the inside bottom surface of the bottom member 132 of the box 128 and an air horn 140 connected to the wall and extending outwardly therefrom into the chamber 134.

Each wall 136 is generally cylindrical in shape, there preferably being one wall corresponding to each combustion chamber 74. The wall 136 is preferably integrally formed with the bottom member 132, and defines a passage 138 which is aligned with the passage through the plate 126 and the respective passage 120 through the carburetor 94.

The air horn member 140 is connected to each wall 136 and extends upwardly therefrom. As illustrated, each horn 140 is annular, having a wall 142 defining a passage 144 through the horn 140 from end to end. A bottom end or skirt portion 146 of the horn 140 is generally cylindrical in shape, and has an inner diameter slightly greater than the outer diameter of the wall 136 so as to fit thereover.

Preferably, means are provided for fastening the horn 140 to the wall 136. As illustrated, this means comprises a band 148. The band 148 may comprise a metal strap or the like having a tightening mechanism for cinching around the skirt portion 146 of the horn 140 to fasten it securely to the wall 136. As illustrated, the skirt portion 146 includes a pair of spaced ribs between which the band 148 is placed, aiding the user in installing the band 148 and maintain the band 148 in position.

The wall 142 defining the opposite or top end of the horn member 140 has a larger diameter than the end of the horn connected to the wall 136 or the wall itself. Preferably, the diameter increases in non-linear fashion, such that the wall curves outwardly at an increasing rate. The horn 140 thus has a flared end positioned within the interior chamber 134.

Air is supplied to the horn 140. In particular, the bottom member 136 of the air box 128 has a wall 150 defining at least one, and preferably a plurality of intake passages 152. Each passage 152 leads from an opening facing downwardly towards the engine 22 and bottom portion 50 of the hull upwardly towards the top member 134 and into the interior chamber 134. The passages 152 are preferably separated within the interior of the box 128 by ribs 153 which extend inwardly from the wall of the top member 130.

As illustrated, means are provided for draining liquid L such as water which enters the interior of the air box 128 to a point exterior of the box. Preferably, this means comprises a plurality of drain passages 154. Each drain passage 154 preferably extends through the portion of the wall defining a bottom of the bottom member 132 of the air box 128, and through a corresponding passage in the adjacent mounting plate 126. In the embodiment illustrated, and referring to FIG. 5, at least three drain passages or holes 154 are provided. A single drain passage 154 may be suitable.

Referring to FIG. 4, an air filter 156 is preferably provided in the air box 128 for filtering the air before it enters the passage 138 through the air horn 140 leading to the engine 22. The air filter 156 preferably comprises a steel screen or mesh having an outer periphery or edge 158 forming a gasket member. The gasket edge 158 is sandwiched between the top and bottom air box members 130, 132, thereby maintaining it in place. As also illustrated, the filter 156 does not extend over the inlets or openings 152 leading into the air box, but instead filters the air as it passes from the portion of the interior chamber 134 defined by the top member 130 and that defined by the lower member 132.

The air intake arranged in accordance with the present invention has several advantages and solves the above-stated problems associated with prior art air intake arrangements. First, air is drawn through an air or intake pipe 91 having its end positioned within an air box, thereby preventing water from directly entering the intake leading to the engine. In addition, the downwardly facing openings leading into the air box 128 serve to prevent entry of water into the box 128. More importantly, however, the air intake is arranged to prevent water which may have entered the air box 128 from entering the intake pipe 91. First, one or more drain passages 154 allow water which enters the air box 128 to drain to a point external to the box.

In addition, the end of the intake pipe (which in the preferred embodiment constitutes the air horn 140 connected to the wall 136) through which air is drawn in the air box is flared. In the event the watercraft is rocked from side-to-side or capsized onto its side, water is prevented from entering the intake pipe. As illustrated by the arrow D in FIG. 4, water is deflected from the intake by the flared wall of the horn 140. If the craft capsizes, water will run over the top of the wall defining the air horn 140, but its directed away from the opening and thus does not enter it. When the craft is righted, the water remaining in the bottom of the box 128 flows through the drain passage(s) 154 from the box.

The ability of the air intake to prevent water intake is also aided by the fact that the intake pipe 91 extends into the interior chamber 134 some distance above the bottom of the bottom member 132. Thus, when the craft 20 is upright, water may pool within the box 128 and not run into the air intake pipe 91, as illustrated in FIG. 4.

As described above, the horn 140 portion of the intake system may be formed separately from the air box 128 including the upwardly extending wall 136. Of course, it is contemplated that the horn 140 and box 128 may be formed integrally. As one example, the wall 136 may extend upwardly a further distance towards the top member 130 and have a flared top end forming the same horn shape. In addition, the intake pipe 91 need not extend from the bottom of the air box 128. For example, the bottom member 132 of the air box 128 may include an aperture therein and an intake pipe (such as an extension from the carburetor) may be extended therethrough and then the air horn connected.

Of course, the foregoing description is that of preferred embodiments of the invention, and various changes and modifications may be made without departing from the spirit and scope of the invention, as defined by the appended claims.

What is claimed is:

1. An air intake adapted to prevent entry of water into an engine, said engine having at least one combustion chamber, an air passage leading from said air intake to said combustion chamber, and a fuel supply for supplying fuel to said combustion chamber for combustion with said air, said air intake including an air box in said air passage and defining an interior chamber, a generally planar type filter element extending across said interior chamber for defining an upper air chamber portion and a lower air chamber portion, at least one atmospheric inlet opening through said air box leading to one of said interior chamber portions, an engine intake pipe forming an outlet opening through said air box from a flared inlet end positioned in the other of said interior chamber portions, said intake pipe having a passage therethrough leading from said other interior chamber portion to said air passage for supplying air to said engine combustion chamber.

2. The air intake system in accordance with claim 1, wherein said fuel supply includes a charge former, said charge former positioned between said air box and said engine along said air passage.

3. The air intake for an engine in accordance with claim 1 in combination with a watercraft having a water propulsion device, said engine powering said water propulsion device and being positioned in a hull of said watercraft.

4. The combination in accordance with claim 3, wherein said intake pipe comprises a wall extending into said other of said interior chamber portions from wall defining said air box.

5. The combination in accordance with claim 4, further including an air horn connected to said intake pipe.

6. The combination in accordance with claim 4, wherein said intake pipe defines a first passage therethrough leading from the other of said interior chamber portions of said box, said fuel supply includes a carburetor and said intake pipe first passage leads to a passage through said carburetor.

7. The combination in accordance with claim 3, wherein said air box comprises a cover attached to a base member, said base member closer to a bottom of said hull than said cover.

8. The combination in accordance with claim 7, wherein said intake pipe extends upwardly from said base member towards said cover within said other of said interior chamber portions.

9. The combination in accordance with claim 7, wherein at least one drain passage extends through said base member.

10. The combination in accordance with claim 7, wherein said air filter is positioned between said air inlet to said box and said intake pipe.

11. The air intake system in accordance with claim 1, wherein the atmospheric air inlet opening is related to at least one of the air chamber portions so that air flowing into the one air chamber portion passes in a first, generally vertical direction, said engine intake pipe being oriented so that the air flows through said engine air intake pipe from said flared inlet end to the engine combustion chamber in an opposite vertical direction so that the air flow through the air box reverses vertical directions for assisting in separation of water from the intake air.

12. The air intake system in accordance with claim 11, wherein the planar type filter element extends in a generally horizontal direction.

13. The air intake system in accordance with claim 1, wherein at least one of the openings through the air box extends through a bottom surface thereof.

14. The air intake system in accordance with claim 13, wherein at least one water drain passage is provided in said bottom surface of said air box.

15. The air intake system in accordance with claim 13, wherein said intake pipe comprises a generally cylindrical wall extending upwardly from said bottom surface of said air box and an air horn connected to said wall.

16. The air intake system in accordance with claim 15, wherein said air horn has a first generally cylindrical end for mating with said wall, said first end having a first diameter, said horn having a second end which has a second diameter which is larger than said first diameter.

17. The air intake system in accordance with claim 1, wherein the air box is comprised of a main housing member and a cover member detachably affixed thereto and wherein the generally planar type filter element extends across the interface between the main housing member and the cover member.

* * * * *